US006237799B1

(12) United States Patent
Emerson

(10) Patent No.: US 6,237,799 B1
(45) Date of Patent: May 29, 2001

(54) UTILITY TRAY

(75) Inventor: Marcia Kim Emerson, Windsor, CO (US)

(73) Assignee: Journey, Inc., Windsor, CO (US)

( * ) Notice: Subject to any disclaimer, the term of this patent is extended or adjusted under 35 U.S.C. 154(b) by 0 days.

(21) Appl. No.: 09/365,114

(22) Filed: Jul. 30, 1999

(51) Int. Cl.[7] ..... B65D 25/24
(52) U.S. Cl. ..... 220/480; 220/476; 220/570
(58) Field of Search ..... 220/570, 476, 220/480; 211/133.4, 133.6; 248/239, 235, 245, 250

(56) References Cited

U.S. PATENT DOCUMENTS 2,694,825 * 11/1954 Touchett et al. ..... 220/570
3,400,829 * 9/1968 Youngson .
3,707,242 * 12/1972 Golden et al. ..... 220/570
5,052,581 * 10/1991 Christ et al. ..... 220/570
5,450,690 * 9/1995 Elsea ..... 47/41.01

* cited by examiner

*Primary Examiner*—Stephen Castellano
(74) *Attorney, Agent, or Firm*—Dean P. Edmundson

(57) ABSTRACT

A utility tray is described which includes a generally planar base and an upright flange extending upwardly from at least three side edges of the tray. The tray can be attached or mounted to any desired support structure such as a bed frame. Attachment to a support structure is made by a threaded bolt which extends through a bar member on the lower surface of the tray to frictionally engage the support structure.

4 Claims, 6 Drawing Sheets

UTILITY TRAY

FIELD OF THE INVENTION

This invention relates to utility trays. More particularly, this invention relates to utility trays which include means for attaching the trays to a support structure.

BACKGROUND OF THE INVENTION

Utility trays are used for a variety of purposes. Some have been previously provided with clamps or arms for attachment to other supporting structure, but such trays are not convenient for use in supporting a variety of personal items on a bed frame, for example.

There has not previously been provided a utility tray having the features and advantages provided by the present invention.

SUMMARY OF THE PRESENT INVENTION

In accordance with the present invention there is provided a utility tray comprising:

(a) a generally horizontal base member, (b) an upright flange member extending upwardly from the back edge and opposing side edges of the base member, and (c) a plurality of spaced-apart attachment means carried by the lower surface of the base member for attaching or mounting the tray to a support structure (e.g. a bed frame or other desired structure).

The base member is normally rectangular or square and the front edge is preferably linear. The base member may be of any desired length, width and thickness.

The tray can be easily attached to a desired support surface such as a bed frame or a shelf or an article of furniture, for example. It can also be detached when desired. The tray can be used to support a variety of items, such as books, a radio, snacks, or other personal items.

Other features and advantages of the product of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
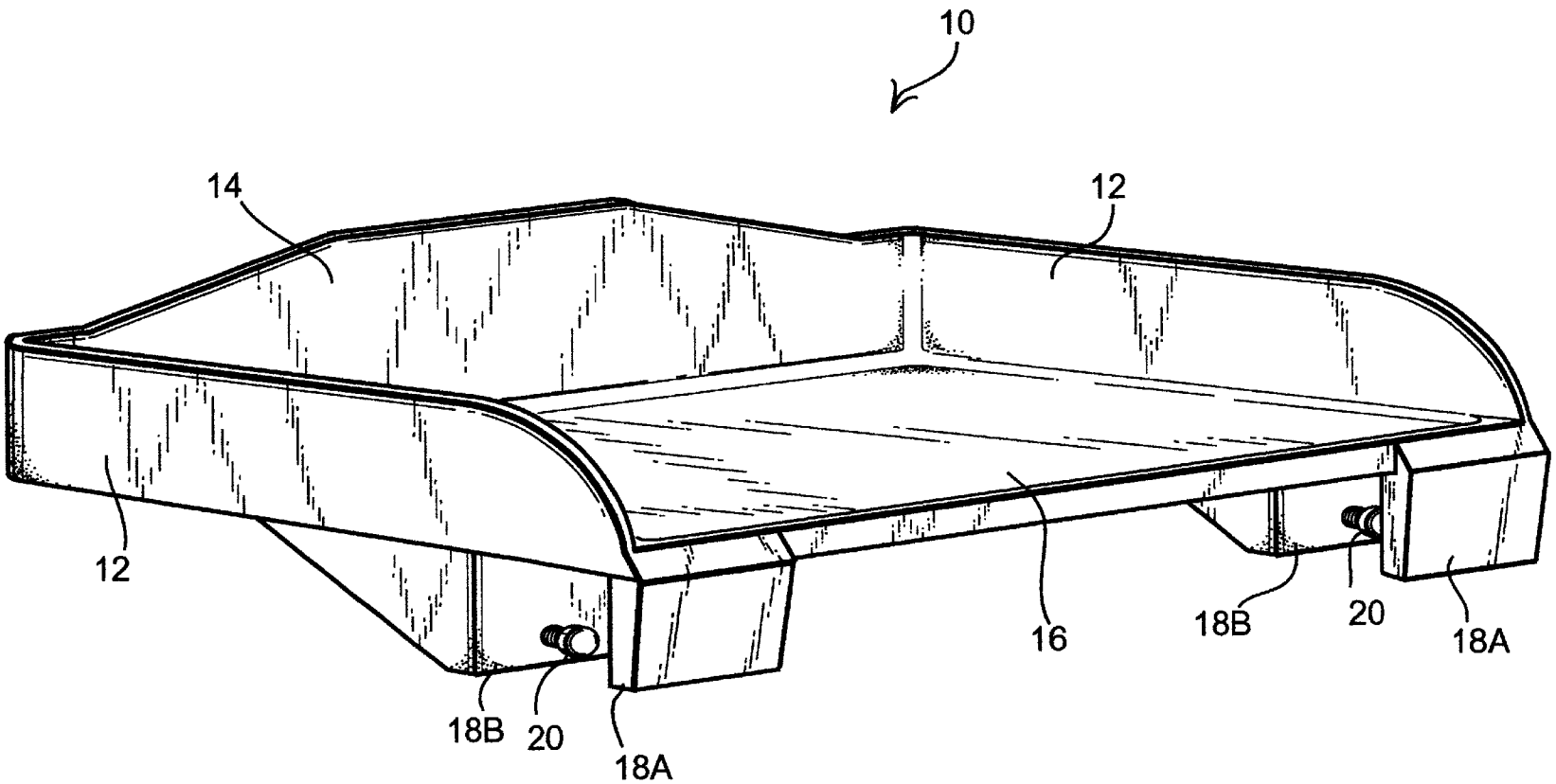
FIG. 1 is an isometric view of one embodiment of tray of the invention.
Figure 2:
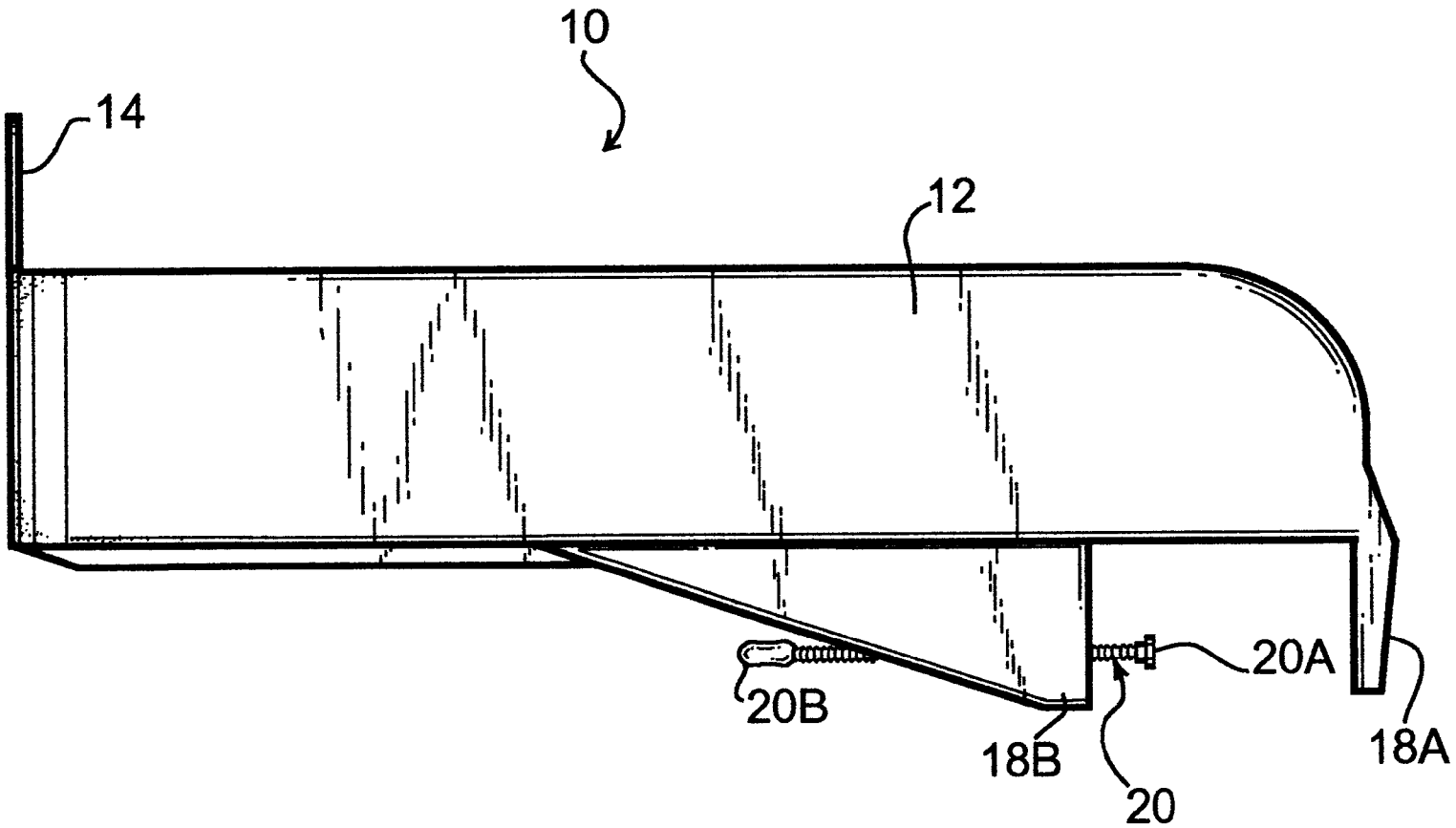
FIG. 2 is a side elevational view of the tray of FIG. 1.

In FIGS. 1 and 2 there is shown one embodiment of a tray 10 of the invention comprising a generally planar horizontal base member 16 with upstanding flange or wall member 12 along opposite sides and upstanding flange 14 along the back edge of the base member. Preferably, the side flanges are connected to or integral with the rear flange 14. The size and shape of the flanges may vary, as desired. It is also possible to have an upstanding flange along the front edge of the tray, if desired.

Extending downwardly from the front edge of the base are bar members 18A. Preferably these bar members are integral with the base member or are otherwise secured to the base member.

Also extending downwardly from the lower surface of the base member are bar members 18B which are spaced from bar members 18A so as to create a space between bar members 18A and 18B for receiving a desired support structure (e.g. a bed frame). Preferably, the opposing faces of bars 18A and 18B are parallel to each other and are generally planar.

Threadably mounted in each bar member 18B is a bolt or screw 20 having an enlarged forward end 20A. The opposite end 20B of the bolt 20 is flattened to facilitate gripping and rotating the bolt to tighten the enlarged end against a support structure located between bars 18A and 18B, whereby the bolt frictionally engages the support structure to firmly mount the tray to the support structure for use.

Figure 3:
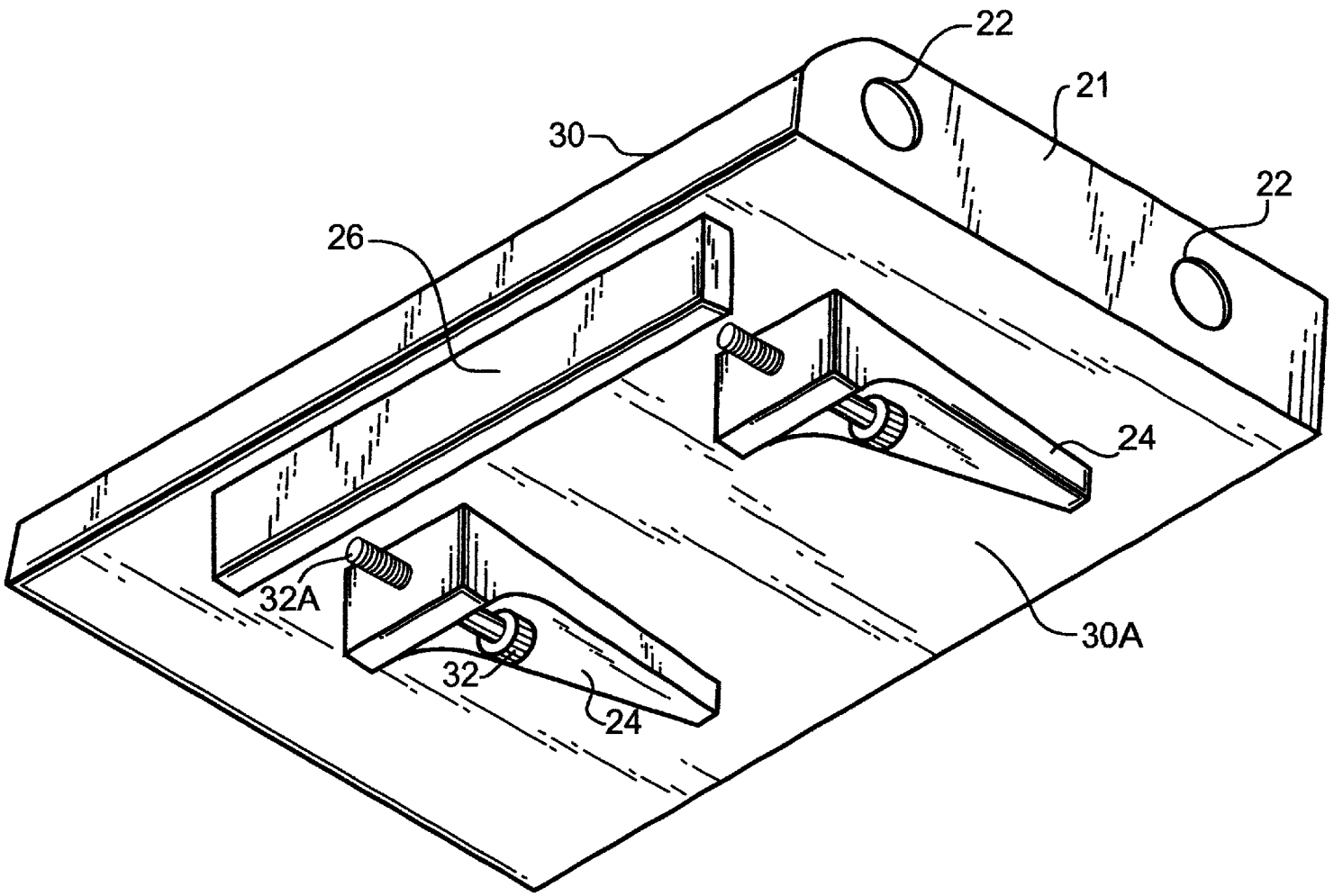
FIG. 3 is a bottom isometric view of another embodiment of a tray of the invention.

FIG. 3 illustrates another embodiment of tray 30 which includes a base member 30A and upstanding flange 21 with openings 22. Extending downwardly from the lower surface of the base is an elongated bar member 26. Spaced rearwardLy from the bar, and secured to the lower surface of the base, are bar members 24. A threaded bolt or screw 32 extends through each bar member 24 and is parallel to the lower surface of the base. By rotating each bolt 32 in one direction, the leading end 32A of the bolt can be urged against a desired support structure between the opposing faces of the bar members 26 and 24.

Figure 4:
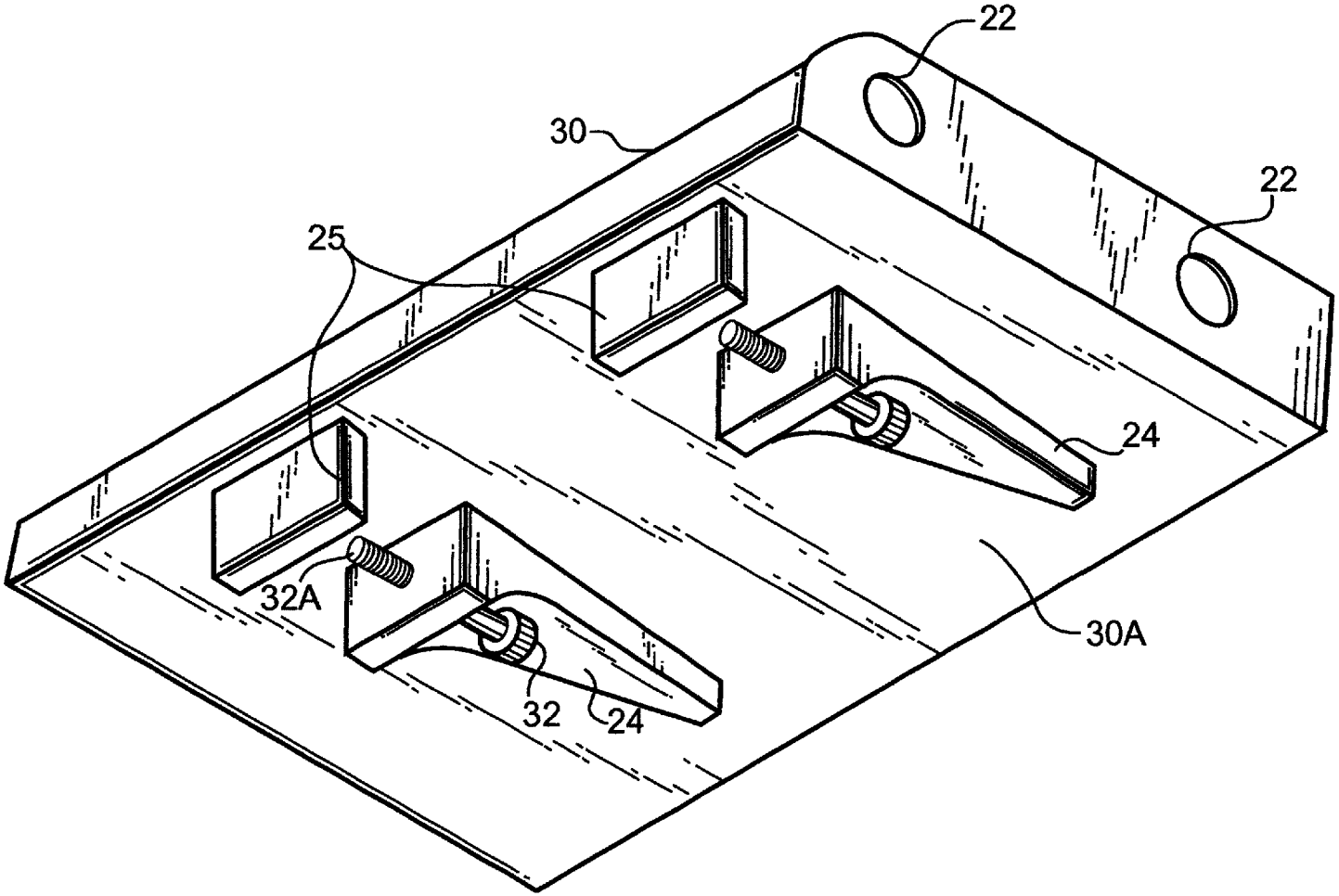
FIG. 4 is a bottom isometric view of yet another embodiment of a tray of the invention.

The tray 30 shown in FIG. 4 is similar to that shown in FIG. 3 except that the single elongated bar member 26 has been replaced with two individual bar members 25, as shown.

Figure 5:
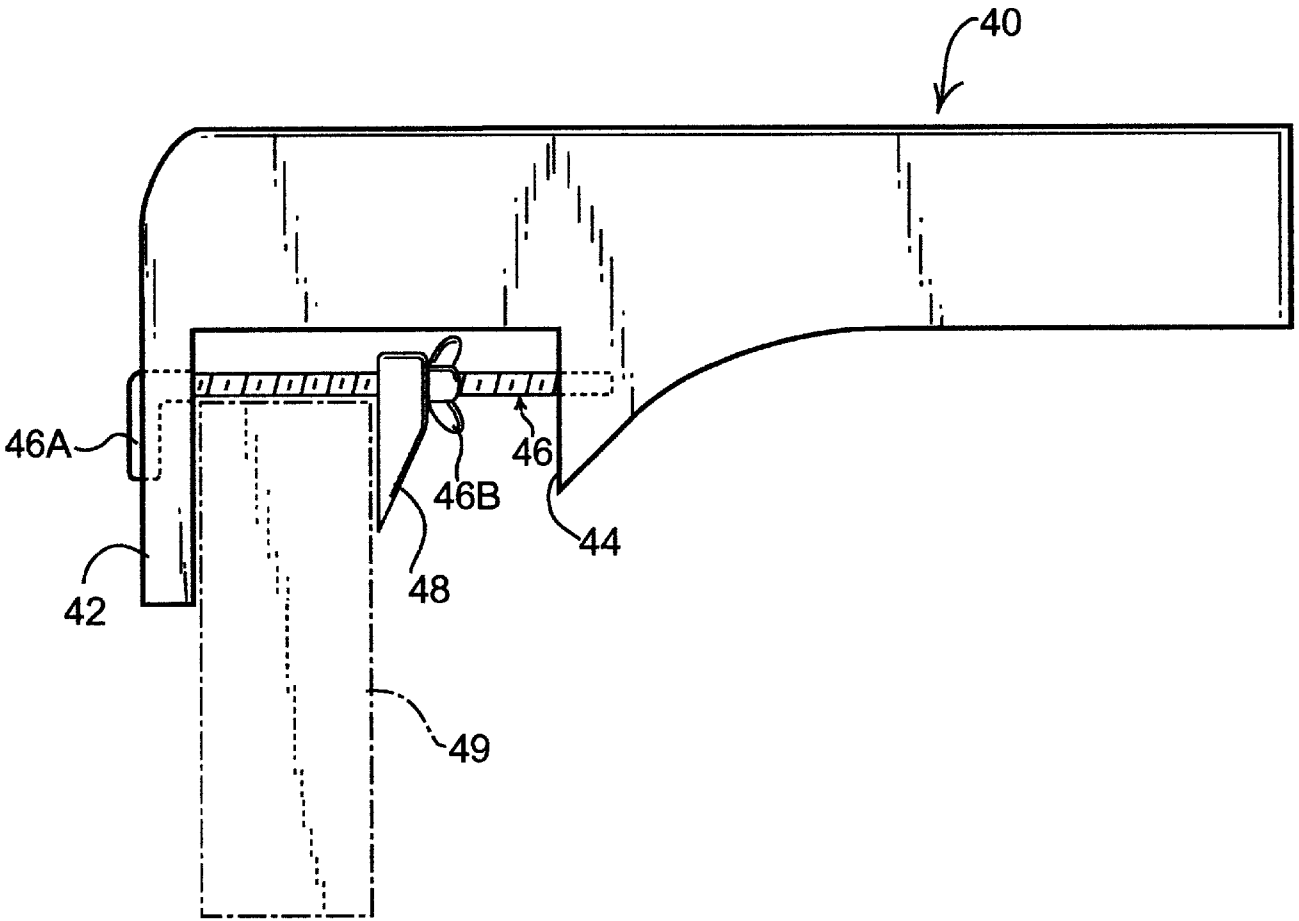
FIG. 5 is a side elevational view illustrating yet another embodiment of a tray of the invention.
Figure 6:
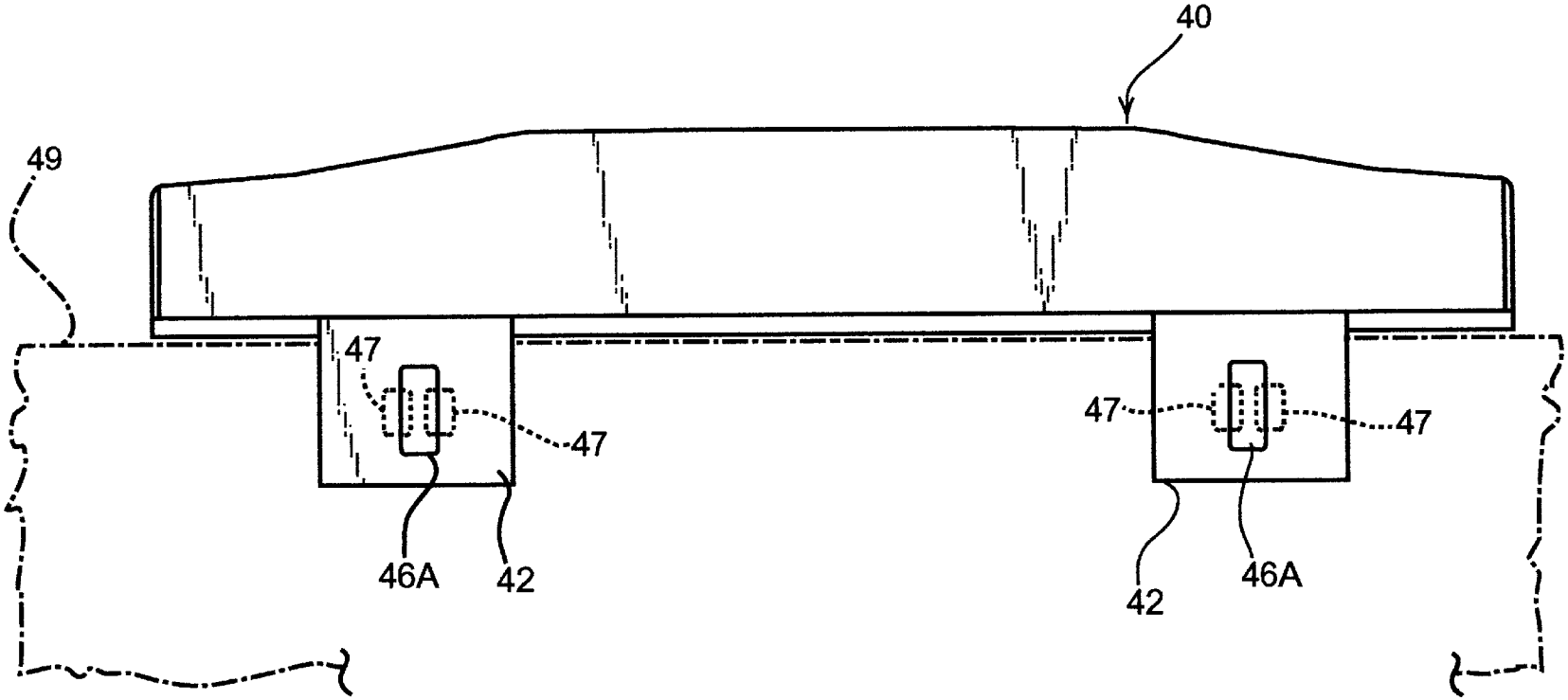
FIG. 6 is a front elevational view of the tray shown in FIG. 5.

FIGS. 5 and 6 illustrate another embodiment of tray 40 of the invention. In this embodiment there are two bar members 42 which extend downwardly from, and are integral with, the front edge of the tray. Spaced rearwardly from each bar member 42 is a downwardly extending finger 44. An L-shaped threaded bolt 46 extends through bar member 42 and the rearward end of the bolt is supported in a recess in the finger 44.

A slide or clamp member 48 is carried by the bolt and it can be urged against a support structure (e.g. a bed rail 49) by turning wing nut 46B on bolt 46. In this manner the tray can be detachably secured to the support structure. In order to retain the bolt 46 in bar member 42, it is possible to include clip members 47 on the front face of bar member 42 which engage end 46A of bolt 46, as illustrated in FIG. 6. The clip members may be formed of plastic or metal, for example.

The tray can be made in any desired size and shape. Generally, a square or rectangular base member is preferred, but other geometric shapes are possible. Preferably, the tray is composed of durable plastic, although it could be composed of other suitable materials such as metal (e.g. aluminum) or composite materials. It is preferable for the base, the flange, and the attachment bar members to be integrally formed. For example, the entire tray can be molded plastic. Then the threaded metal bolts are added.

Other variants are possible without departing from the scope of this invention.

What is claimed is:

1. A utility tray capable of being detachably mounted on a support structure having parallel opposite side surfaces, the tray comprising:

(a) a generally horizontal base member having upper and lower surfaces, a back edge, side edges, and a front edge;

(b) an upright flange member extending upwardly from said back edge and said side edges;

(c) a plurality of spaced-apart attachment means carried by said lower surface of said base member adjacent said front edge for detachable mounting of said tray to said support structure; wherein each said attachment means comprises (1) opposing bar members extending downwardly from and being secured to said lower surface of said base member, wherein said opposing bar members include faces which are parallel to each other and define a space therebetween for receiving said opposite side surfaces of said support structure, and (2) a threaded member carried by one of said bar members and being adapted to engage one of said opposite side surfaces of said support structure to thereby secure said tray to said support structure, the bar member which does not carry said threaded member being imperfoate.

2. The tray in accordance with claim 1, wherein said base member is rectangular.

3. The tray in accordance with claim 1, wherein said base member is square.

4. A combination comprising:

(a) a support structure having parallel, vertical opposite side surfaces; and (b) a utility tray detachably secured to said opposite side surfaces of said support structure, the tray comprising:

(i) a generally horizontal base member having upper and lower surfaces, a back edge, side edges, and a front edge;

(ii) an upright flange member extending upwardly from said back edge and said side edges;

(iii) a plurality of spaced-apart attachment means carried by said lower surface of said base member adjacent said front edge for detachable mounting of said tray to said support structure; wherein each said attachment means comprises (1) opposing bar members extending downwardly from and being secured to said lower surface of said base member, wherein said opposing bar members include faces which are parallel to each other and define a space therebetween for receiving said support structure, and (2) a threaded member carried by one of said bar members and being adapted to engage one of said opposite side surfaces of said support structure.

* * * * *